United States Patent [19]

Gerrick

[11] Patent Number: 4,955,095

[45] Date of Patent: Sep. 11, 1990

[54] REMOVABLE PILLOW TOP FOR MATTRESS

[75] Inventor: Jack M. Gerrick, Fort Worth, Tex.

[73] Assignee: International Bedding Corporation, Fort Lauderdale, Fla.

[21] Appl. No.: 318,650

[22] Filed: Mar. 3, 1989

[51] Int. Cl.[5] ..... A47C 20/02

[52] U.S. Cl. ..... 5/446; 5/462; 5/470; 5/481

[58] Field of Search ..... 5/448, 462, 470, 471, 5/474, 481, 446, 402

[56] References Cited

U.S. PATENT DOCUMENTS

| | | | |
|---|---|---|---|
| 1,583,334 | 5/1926 | Bloom | 5/470 |
| 1,841,410 | 1/1932 | Karr | 5/498 |
| 1,900,801 | 3/1933 | Cobb | 5/448 |
| 2,638,608 | 5/1953 | Garrigus | 5/47 |
| 3,308,490 | 3/1967 | Cacioppo | 5/470 |
| 4,405,681 | 9/1983 | McEvoy | 5/481 |
| 4,809,375 | 3/1989 | Bull | 5/470 |

FOREIGN PATENT DOCUMENTS

| | | | |
|---|---|---|---|
| 1079794 | 4/1960 | Fed. Rep. of Germany | 5/481 |
| 673547 | 3/1962 | Italy | 5/481 |

OTHER PUBLICATIONS

Publication to Libelle etc., date: unknown.

*Primary Examiner*—Michael F. Trettel
*Assistant Examiner*—Flemming Saether
*Attorney, Agent, or Firm*—Arthur F. Zobal

[57] ABSTRACT

A removable pillow top for use as the top member of a bed protects the inner spring bed mattress. The pillow top has a cover, a support member, and a cushion. The cover has top and bottom walls and side walls coupled together to form an interior space for receiving the support member and the cushion. The support member is made of foam and has a bottom wall and side walls forming a shallow cavity for receiving the cushion. The cover has a closable opening for allowing insertion and removal of the support member and the cushion. The bottom wall of the cover has fasteners for removable coupling with fasteners on the top surface of the inner spring mattress. If soiled, the pillow top is removed from the protected inner spring mattress and cleaned. To clean the pillow top, the support member and cushion can be removed for cleaning and replaced.

15 Claims, 3 Drawing Sheets

REMOVABLE PILLOW TOP FOR MATTRESS

FIELD OF THE INVENTION

The present invention relates to pillow tops for use on bed mattresses.

BACKGROUND OF THE INVENTION

Beds typically include a bottom or box spring mattress and a top or inner spring mattress. The sleeping occupant lies on top of the inner spring mattress, which in the hotel industry is typically protected only by sheets. As such, the inner spring mattress is subject to damage from vomitus, urine, or the like. The sheets offer little protection, because fluids easily pass through the sheets into the top portion of the inner spring mattress. Once soiled, it is difficult to satisfactorily and economically clean the inner spring mattress.

Disposal of the soiled mattress and replacement with a new mattress is the most effective procedure to obtain a clean mattress. Disposal and replacement is the preferred procedure of the hotel industry, which utilizes large numbers of mattresses. Thus, for the hotel industry, soiled mattresses represent a costly part of doing business. Mattresses in residential use also suffer from the same soiling problems. What is needed is a device that will protect the mattress and still offer comfort.

Prior art forms of protection suffer from disadvantages. Mattress pads, which are thin quilted pads located between the mattress and the sheets pass fluids and are thus inadequate. Plastic covers provide full protection to the mattress but are generally uncomfortable to sleep on.

SUMMARY OF THE INVENTION

It is an object of the present invention to provide a device that will protect the mattresses of beds and that will also provide comfort.

The pillow top of the present invention includes a cover, a cushion means, and fastener means. The cover has first and second walls positionable adjacent to each other so as to be generally parallel and so as to form an interior space. An opening in the cover allows access to the interior space. Closure means is provided for opening and closing the opening. The cushion means is locatable in the cover interior space via the opening, wherein the closure means allows the removal of the cushion means. The fastener means is adapted for removably fastening the cover to a bed mattress. In use the pillow top is installed to overlay the bed mattress. Once installed, the pillow top protects the bed mattress from damage or soiling. If the pillow top becomes soiled, it is removed from the bed mattress and cleaned. To clean the cover, the cushion means can be removed. The cover and the cushion means are interchangeable and can be individually replaced as necessary. Furthermore, the cushion means can be interchanged to provide a selected degree of hardness or softness.

In one aspect, the cover has side walls, the edges of which are coupled to the edges of the first and second walls. In another aspect, the pillow top has support means having bottom and side walls. The support means has a shallow cavity for receiving the cushion means. The support means is locatable in the interior space of the cover such that the support means bottom wall is interposed between the cushion means and the cover second wall.

DESCRIPTION OF PREFERRED EMBODIMENTS

Figure 1:
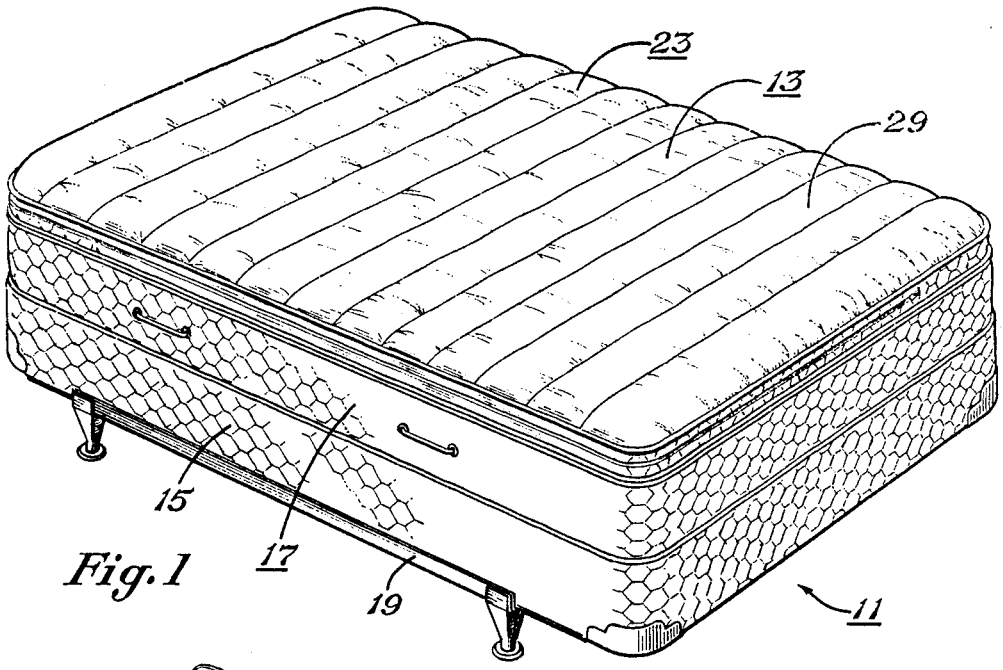
FIG. 1 is a perspective view of a bed incorporating the pillow top of the present invention, in accordance with a preferred embodiment.

In FIG. 1, there is shown a perspective view of a bed 11 incorporating the pillow top 13 of the present invention, in accordance with a preferred embodiment. The bed 11 includes the pillow top 13, a box spring or lower mattress 15, an inner spring or upper mattress 17, and a bed frame 19. The box spring and inner spring mattresses 15, 17 are conventional except for the modification to the inner spring mattress 17 to be described subsequently. The box spring mattress 15 is fitted into the bed frame 19 which supports the mattress a short distance above the floor.

Figure 2:
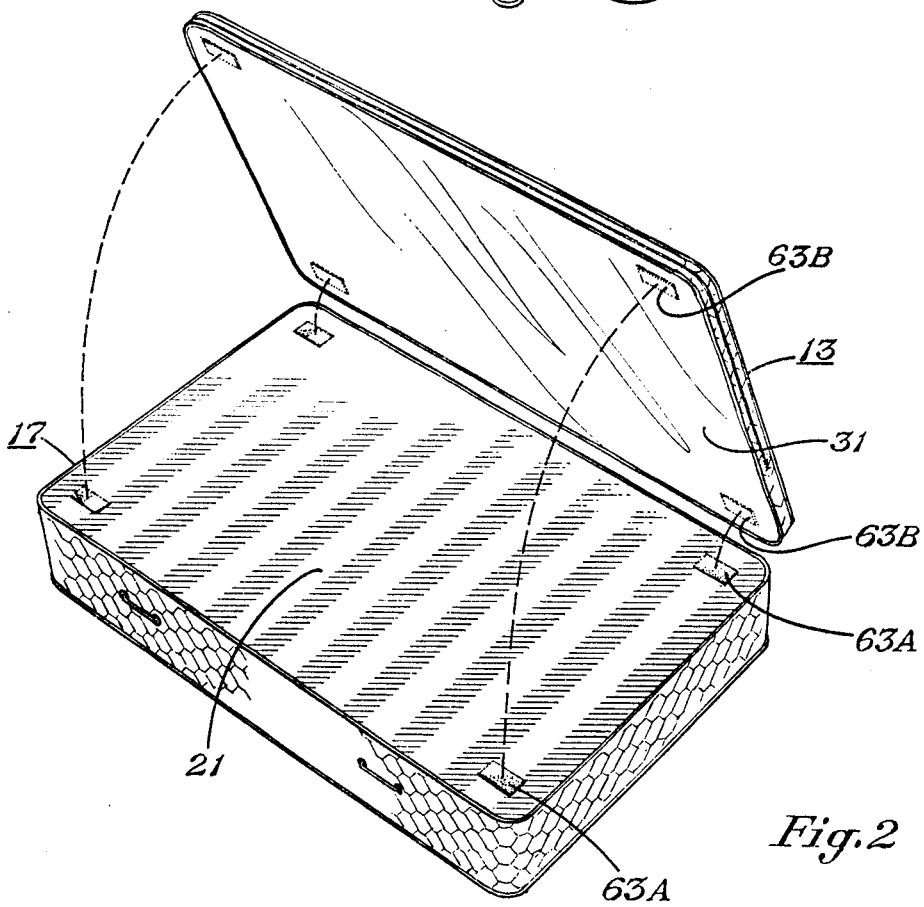
FIG. 2 is an isometric view of the pillow top and the inner spring mattress, showing how the pillow top is removably fastened to the inner spring mattress.
Figure 3:
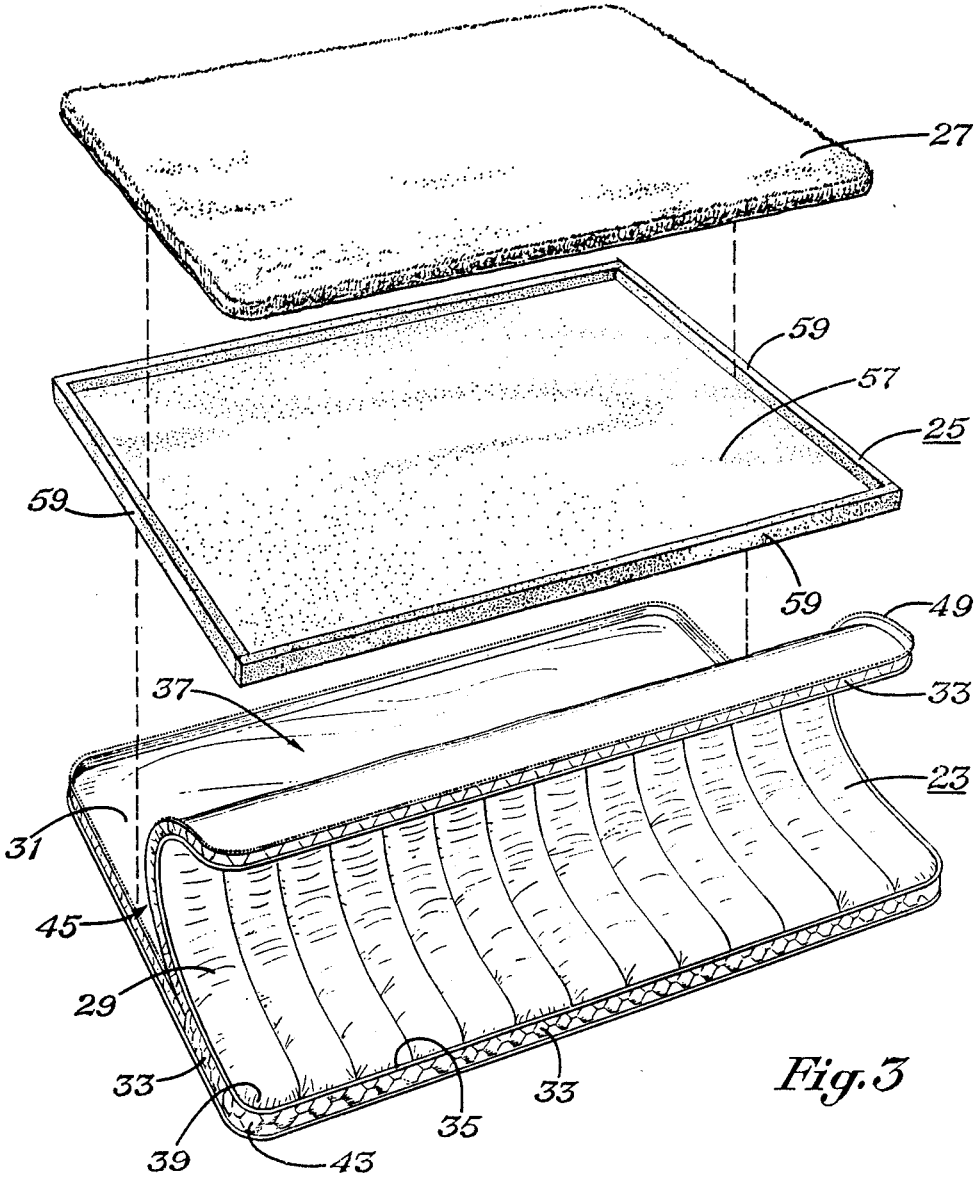
FIG. 3 is an exploded isometric view of the pillow top.

The pillow top 13 is removably fastened to the top surface 21 of the inner spring mattress 17 as shown in FIG. 2. The pillow top 13 overlies the inner spring mattress 17, protecting the inner spring from damage or soiling. Referring to FIG. 3, the pillow top 13 includes a over 23, a support member 25, and a cushion 27.

Figure 5:
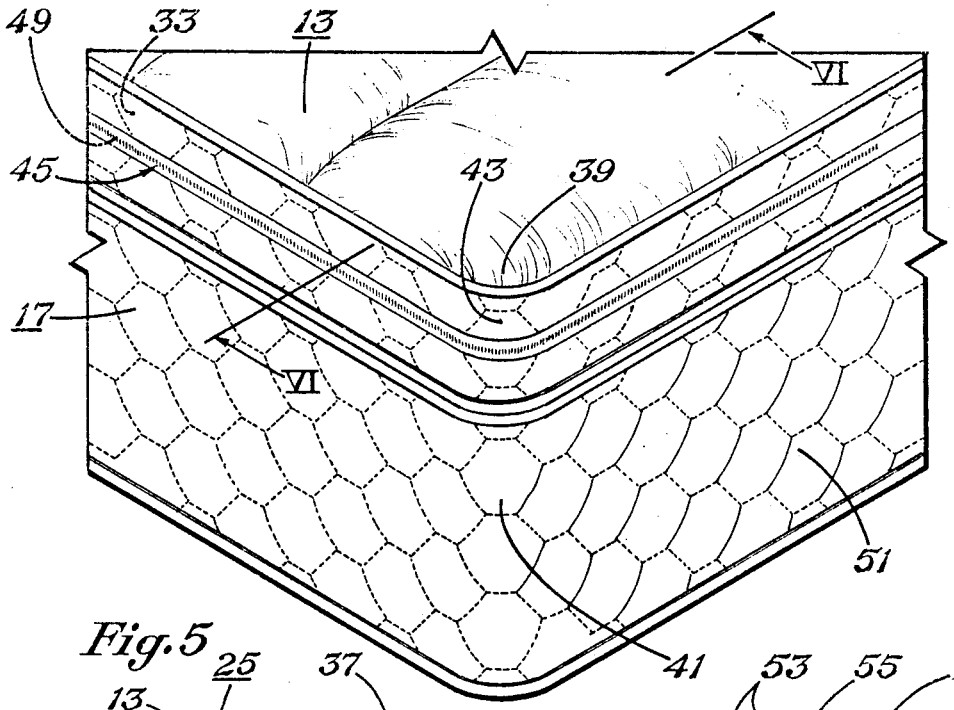
FIG. 5 is a detail view of a corner of the pillow top and the inner spring mattress.
Figure 6:
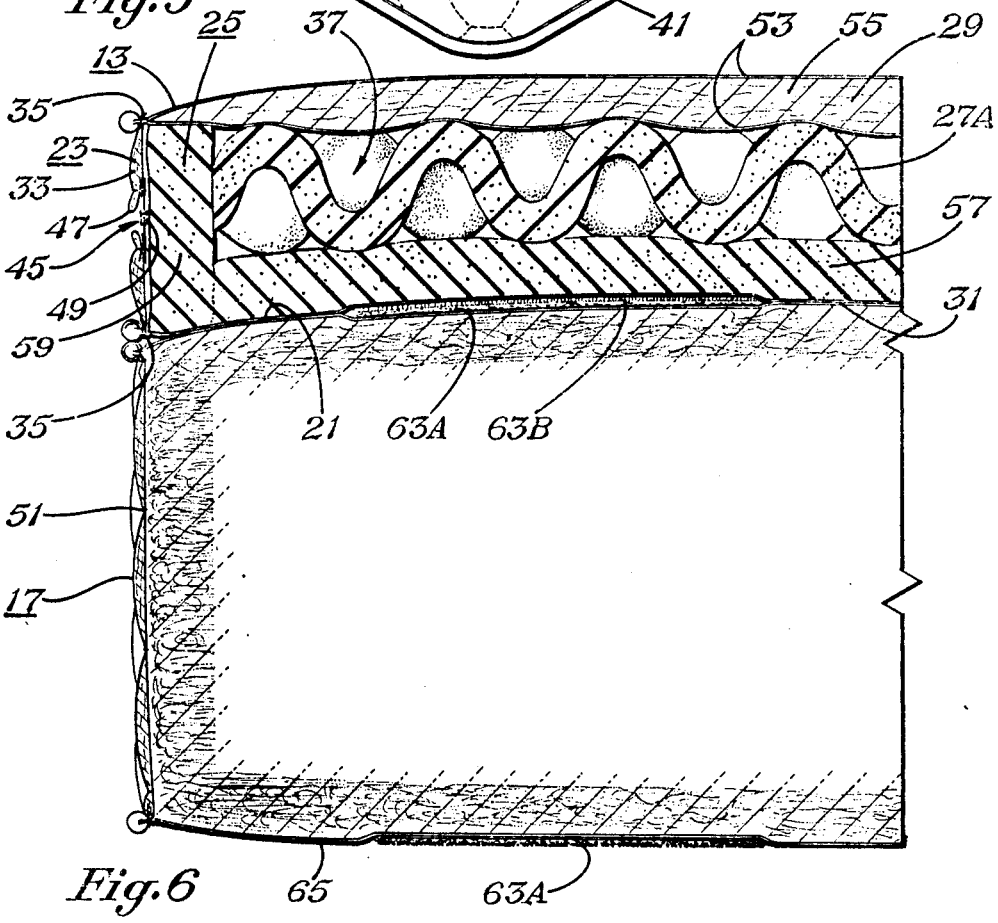
FIG. 6 is a cross-sectional view taken along lines VI—VI of FIG. 5.

Referring to FIGS. 3 and 6, the cover 23 has top and bottom walls 29, 31 that are generally rectangular in shape. The cover 23 also has four side walls 33, the edges of which are coupled to the edges 35 of the top and bottom walls 29, 31. The cover walls form a thin enclosure with an interior cavity 37, where the top and bottom walls 29, 31 are generally parallel to each other and the side walls 33 are generally perpendicular to the top and bottom walls. The corners 39 of the top and bottom walls are rounded to conform to the corners 41 of the inner spring mattress (see FIG. 5). As a result, the ends of each side wall merge with the ends of the adjacent side walls to form rounded corners 43. The cover 23 has an opening 45 in three of the side walls 33 to allow access to the interior cavity 37 from the exterior of the cover. The opening 45 extends along one of the longer side walls and through adjacent portions of the shorter side walls. The opening 45 extends parallel to the edges 35 of the top and bottom walls 29, 31. The opening 45 can be enlarged by rolling the top wall 29 back, relative to the bottom wall 31, as shown in FIG. 3. The edges 47 of the side walls lining the opening 45 are fitted with a zipper 49 to allow the closing of the opening.

The top and bottom walls 29, 31 of the cover 23 are approximately the same size as the top surface 21 of the inner spring mattress 17, so that when the pillow top 13 is installed on top of the inner spring mattress, the side walls 33 of the pillow top are approximately coplanar with the respective side walls 51 of the inner spring mattress. The walls of the cover 23 are flexible and are made of fabric or cloth which may be of cotton or suitable synthetic material. The top wall 29, which is quilted, has two layers of fabric 53 and filling material 55 interposed between the layers. In the preferred embodiment, the filling material 55 is made up of hollow fill fibers to allow dry cleaning of the cover. Polyurethane foam can be used in place of the hollow fill fibers. The side walls 33 are also quilted to aesthetically blend with the side walls 51 of the inner spring mattress 17.

The support member 25 has a bottom wall 57 and four side walls 59. The bottom wall 57 is rectangular in shape and the side walls 59 are thin rectangular strips. The walls 57, 59 of the support member 25 are made of flexible and resilient polyurethane foam suitable for comfortably supporting a person. In the preferred embodiment, the side walls 59 are made of a stiffer foam than the foam used in the bottom wall 57. The side walls 59 are glued to the edges of the bottom wall 57 so as to completely circumscribe the bottom wall. The side walls 59 extend perpendicularly to the bottom wall wherein a shallow cavity is formed. The size of the support member 25 is such that it fits within the interior cavity 37 of the cover 23.

Figure 4:
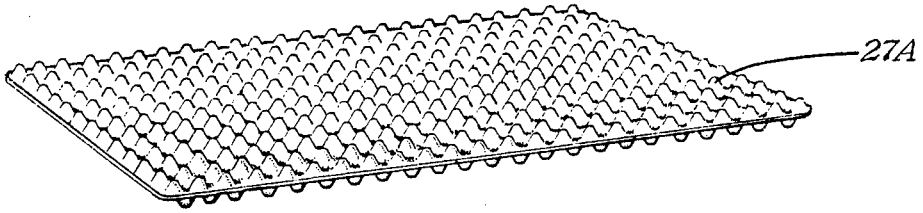
FIG. 4 is an isometric view of the cushion, in accordance with another embodiment.

The cushion 27 is a generally rectangular piece of soft material such as lamb's wool. Alternatively, a piece of flexible and resilient convoluted polyurethane foam 27A could be used as a cushion (see FIGS. 4 and 6). In the preferred embodiment, the convoluted foam 27A is softer than the foam making up the support member 25. The cushion 27 (or 27A) is sized to be matingly received by the shallow cavity of the support member 25, wherein the edges of the cushion contact or are close to the support member side walls 59.

To assemble the pillow top 13, the cover opening 45 is opened by unzipping the zipper 49. The opening 45 is enlarged by rolling the top wall 29 back away from the bottom wall 31 as shown in FIG. 3. The cushion 27 is inserted into the shallow cavity of the support member 25. The cushion-support member assembly 25, 27 is then inserted into the interior cavity 37 of the cover 23 such that the cushion 27 is interposed between the top wall 29 of the cover and the bottom wall 57 of the support member 25. The zipper 49 is then zipped closed to close the opening 45. When assembled, the support member 25 and the cushion 27 matingly fit inside of the interior cavity 37 of the cover. The support member 25 provides support at the edges of the pillow top and also serves to maintain the cushion 27 in place.

The pillow top 13 is located on the top surface 21 of the inner spring mattress 17, with the bottom wall 31 of the cover 23 contacting the top surface of the inner spring mattress. To prevent slippage between the pillow top 13 and the inner spring mattress 17, hook and loop fasteners 63A, 63B (such as VELCRO) are used (see FIGS. 2 and 6). The hook and loop fasteners have a loop element 63A and a hook element 63B. Plural pieces of one of the fastener elements 63A are secured to the top surface 21 of the inner spring mattress 17, while plural pieces of the other of the fastener elements 63B are secured to the exterior surface of the bottom wall 31 of the cover 23. The respective fastener elements 63A, 63B are located so as to insure their mutual alignment and engagement when the pillow top is installed onto the inner spring mattress.

The bottom surface 65 of the inner spring mattress 17 is fitted with plural pieces of one of the fastener elements 63A (see FIG. 6) so that when the inner spring mattress is turned upside down to extend its life, the pillow top 13 can be secured to the new top surface 65. Furthermore, by providing the top surface (not shown) of the box spring mattress with pieces of the other of the fastener elements, slippage between the inner spring mattress 17 and the box spring mattress 15 can be prevented.

With the pillow top 13 installed on top of the inner spring mattress 17, the inner spring mattress is protected from damage or soiling. The bed 11 is made up with sheets that overlay the pillow top. The pillow top is about 2–2½ inches in height, enabling the use of conventional sheets. Should the pillow top 13 be soiled, it is removed from the bed by unfastening the fasteners 63A, 63B. The cushion 27 and the support member 25 are removed from the cover 23 so that the cover can be dry cleaned. The cushion and the support member can be cleaned if soiled, and reinserted into the clean cover. The cleaned pillow top is then reinstalled on the inner spring mattress. Should the cover 23 be too soiled or damaged to be unusable, the cover can be replaced with the original cushion and support member inserted into the new cover. Likewise, should either of the cushion or the support member be too damaged or soiled, they can be replaced. The pillow top components are thus interchangeable and allow the cleaning or replacement of individual components as required. Cleaning and the interchangeability of the pillow top components provides an efficient and economical alternative to cleaning or replacement of the inner spring mattress.

The pillow top gives the bed a soft plush feeling. The softness of the pillow top can be adjusted to suit individual requirements by selecting a cushion (and/or a support member) of suitable softness or hardness.

Although the pillow top has been described as having a zipper for closing the side wall opening, other types of closure means can be used. Furthermore, although the pillow top has been described as having hook and loop fasteners for securing the pillow top to the inner spring mattress, other types of fastener means that allow the removable of the pillow top can be used.

Although the pillow top has been described as having a cushion and a support member, these two components can be combined into a single member. For example, a block of foam can be inserted into the interior cavity 37 of the cover 23. The block of foam, which is matingly received by the interior cavity, serves as both a support and a cushion.

The foregoing disclosure and the showings made in the drawings are merely illustrative of the principles of this invention and are not to be interpreted in a limiting sense.

I claim:

1. A pillow top device for use with a bed mattress, comprising:

(a) a cover having first and second walls positioned adjacent to each other so as to be generally parallel, said first and second walls having edges which are coupled together so as to form an interior space between said first and second walls, said cover having an opening that allows access from said interior space from the exterior of said cover, said cover having means for opening and closing said opening;

(b) cushion means for providing a cushion, said cushion means being, locatable in said interior space via said opening, wherein said closure means allows the removal of said cushion means;

(c) support means for providing support of said cover and said cushion means, said support means having a bottom wall and side walls coupled to the edges of said bottom wall, said side walls extending transversely from said bottom wall so as to form a shallow cavity, said cushion means being received by said shallow cavity, said support means being locatable in said cover interior space via said opening such that said bottom wall is interposed between said cushion means and one of said walls of said cover and such that said cushion means is surrounded by said support member side walls;

(d) fastener means adapted for removably fastening said cover to a bed mattress, said fastener means being on the exterior of said second wall.

2. The pillow top device of claim 1 wherein said bottom and side walls of said support means are made of a flexible and resilient polyurethane foam.

3. The pillow top device of claim 2 wherein said cushion means comprises convoluted polyurethane foam which is flexible and resilient.

4. The pillow top device of claim 2 wherein said cushion means comprises lamb's wool.

5. The pillow top device of claim 1 wherein said first wall of said cover comprises quilted filling material.

6. The pillow top device of claim 2 wherein said fastener means comprises hook and loop fasteners.

7. A pillow top device for use with a bed mattress, comprising:

(a) a cover having first and second walls adapted to be positioned adjacent to each other so as to be generally parallel with each other, said cover having side walls, said side walls having edges that are coupled to the edges of said first and second walls so as to form an interior space between said first, second and side walls, said cover having an opening for allowing access to said interior space from the exterior of said cover, said cover having means for opening and closing said opening;

(b) support means for supporting said cover having a bottom wall and side walls coupled to the edges of said bottom wall, said support means side walls extending transversely from said bottom wall so as to form a receptacle having an opening defined by said side walls, said support means being adapted to be located in said cover interior cavity such that said bottom wall is generally parallel to said cover first and second walls;

(c) cushion means for providing a cushion, said cushion being separate from said support means and removably receivable by said support means receptacle by way of said opening of said support means receptacle, said support means and said cushion means being adapted to be removably located in said interior space via said opening in said cover side walls, wherein said means for opening and closing said opening of said cover allows the removal of said support means and said cushion means;

(d) fastener means adapted for removably fastening said cover to a bed mattress, said fastener means being on the exterior of said second wall.

8. The pillow top device of claim 7, wherein:

said fastener means on the exterior of said second wall comprises a plurality of separate spaced apart fasteners.

9. The pillow top device of claim 7, wherein:

said bottom wall and said side walls of said support means are formed of a foam material.

10. The pillow top device of claim 9, wherein:

said side walls of said support means are formed of a stiffer foam material than that of said bottom wall.

11. A bed, comprising:

(a) a cover having first and second walls adapted to be positioned adjacent to each other so as to be generally parallel, said first and second walls having edges which are coupled together so as to form an interior space between said first and second walls, said cover having an opening that allows access to said interior space from the exterior of said cover, said cover having means for opening and closing said opening;

(b) cushion means for providing a cushion, said cushion means being adapted to be removably located in said interior space via said opening, wherein said means for opening and closing said opening allows the removal of said cushion means;

(c) support means for providing support of said cover and said cushion means, said support means having a bottom wall and side walls coupled to the edges of bottom wall, said side walls extending transversely from said bottom wall so as to from a shallow cavity having an opening defined by said side walls, said cushion means being separate from said support means and removably receivable by said shallow cavity by way of said opening of said cavity of said support means, said support means being adapted to be located in said cover interior space such that said bottom wall is interposable between said cushion means and said cover second wall and such that said cushion means is surrounded by said support member side walls;

(d) a bed mattress having a top surface, said cover having approximately the same areal dimensions as the bed mattress top surface;

(e) fastener means for removably fastening said cover second wall to said bed mattress top surface.

12. The bed of claim 11 wherein said fastener means comprises hook and loop fasteners.

13. The bed of claim 11 wherein said bed mattress has a bottom surface, said bottom surface having alternate fastener means for removably fastening said cover second wall to said bed mattress bottom surface, wherein said alternate fastener means allows said bed mattress to be turned so that said bottom surface is on top and said top surface is on the bottom.

14. The bed of claim 11, wherein:

said bottom wall and said side walls of said support means are formed of a foam material.

15. The bed of claim 14, wherein:

said side walls of said support means are formed of a stiffer foam material than that of said bottom wall.

* * * * *